US010022784B2

(12) United States Patent
Kurosawa et al.

(10) Patent No.: US 10,022,784 B2
(45) Date of Patent: Jul. 17, 2018

(54) CONTINUOUS CASTING METHOD FOR INGOTS OBTAINED FROM TITANIUM OR TITANIUM ALLOY

(71) Applicant: KOBE STEEL, LTD., Kobe-shi (JP)

(72) Inventors: Eisuke Kurosawa, Hyogo (JP); Takehiro Nakaoka, Hyogo (JP); Kazuyuki Tsutsumi, Hyogo (JP); Hideto Oyama, Hyogo (JP); Hidetaka Kanahashi, Hyogo (JP)

(73) Assignee: KOBE STEEL, LTD., Kobe-shi (JP)

( * ) Notice: Subject to any disclaimer, the term of this patent is extended or adjusted under 35 U.S.C. 154(b) by 0 days.

(21) Appl. No.: 15/296,559

(22) Filed: Oct. 18, 2016

(65) Prior Publication Data

US 2017/0036265 A1 Feb. 9, 2017

Related U.S. Application Data

(62) Division of application No. 14/895,750, filed as application No. PCT/JP2014/065517 on Jun. 11, 2014, now abandoned.

(30) Foreign Application Priority Data

Jun. 27, 2013 (JP) ..... 2013-135205

(51) Int. Cl.
*B22D 11/00* (2006.01)
*B22D 11/041* (2006.01)
(Continued)

(52) U.S. Cl.
CPC ..... *B22D 11/001* (2013.01); *B22D 7/005* (2013.01); *B22D 9/006* (2013.01); *B22D 11/041* (2013.01);
(Continued)

(58) Field of Classification Search
CPC . B22D 11/001; B22D 11/041; B22D 11/1213; B22D 11/14; B22D 11/141;
(Continued)

(56) References Cited

U.S. PATENT DOCUMENTS 3,820,586 A 6/1974 Takei
3,894,573 A 7/1975 Paton
(Continued)

FOREIGN PATENT DOCUMENTS

EP 0 518 537 A1 12/1992
JP 3077387 B2 8/2000
(Continued)

OTHER PUBLICATIONS

International Search Report dated Sep. 2, 2014 in PCT/JP2014/065517 (with English language translation).
(Continued)

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

For continuously casting an ingot of titanium or titanium alloy, molten titanium or titanium alloy is poured into a top opening of a bottomless mold with a circular cross-sectional shape, the solidified molten metal in the mold is pulled downward from the mold, a plurality of plasma torches disposed on an upper side of molten metal in the mold such that their centers are located directly vertically above the molten metal in the mold, are operated to generate plasma arcs that heat the molten metal in the mold, and the plasma torches are moved in a horizontal direction above a melt surface of the molten metal in the mold, along a trajectory located directly vertically above the molten metal in the mold, while keeping a mutual distance between the respec-
(Continued)

tive plasma torches such that the plasma torches do not interfere with each other.

5 Claims, 31 Drawing Sheets

(51) Int. Cl.

| | |
|---|---|
| ***B22D 7/00*** | (2006.01) |
| ***B22D 9/00*** | (2006.01) |
| ***B22D 11/12*** | (2006.01) |
| ***B22D 11/14*** | (2006.01) |
| ***B22D 11/11*** | (2006.01) |
| ***B22D 11/117*** | (2006.01) |
| ***B22D 21/00*** | (2006.01) |
| ***B22D 27/06*** | (2006.01) |
| ***H05H 1/44*** | (2006.01) |
| *F27D 99/00* | (2010.01) |

(52) U.S. Cl.
CPC ..... *B22D 11/11* (2013.01); *B22D 11/117* (2013.01); *B22D 11/1213* (2013.01); *B22D 11/14* (2013.01); *B22D 11/141* (2013.01); *B22D 21/005* (2013.01); *B22D 27/06* (2013.01); *H05H 1/44* (2013.01); *F27D 2099/0031* (2013.01)

(58) Field of Classification Search
CPC ..... B22D 11/11; B22D 11/117; B22D 27/06; B22D 27/005; B22D 21/005; B22D 9/006
See application file for complete search history.

(56) References Cited

U.S. PATENT DOCUMENTS

| | | | | |
|---|---|---|---|---|
| 5,273,101 | A | 12/1993 | Lillquist et al. | |
| 2004/0055730 | A1 | 3/2004 | Jackson et al. | |
| 2008/0035298 | A1* | 2/2008 | Yu ..... | B22D 11/22 164/455 |

FOREIGN PATENT DOCUMENTS

| | | | |
|---|---|---|---|
| JP | 2009-172665 | A | 8/2009 |
| JP | 2013-81980 | A | 5/2013 |
| JP | 2013-81981 | A | 5/2013 |
| WO | WO 91/00158 | A1 | 1/1991 |

OTHER PUBLICATIONS

Written Opinion dated Sep. 2, 2014 in PCT/JP2014/065517 (with English language translation).

Malley et al. "Control of Plasma Hearth Melted Ingot Surfaces", Proceedings of the Tenth International Conference on Vacuum Metallurgy, Metallurgical Industry Press, 1991, pp. 178-188.

Extended European Search Report dated Jan. 26, 2017 in Patent Application No. 14817724.9.

* cited by examiner

CONTINUOUS CASTING METHOD FOR INGOTS OBTAINED FROM TITANIUM OR TITANIUM ALLOY

CROSS-REFERENCE TO RELATED APPLICATIONS

The application is a divisional application of U.S. application Ser. No. 14/895,750, filed Dec. 3, 2015, which is a National Stage application of PCT/JP2014/065517, filed on Jun. 11, 2014 which is based upon and claims the benefit of priority from Japanese Patent Application No. 2013-135205, filed Jun. 27, 2013; the entire contents of all of which are incorporated herein by reference.

FIELD

The present invention relates to a continuous casting method of an ingot formed of titanium or a titanium alloy.

BACKGROUND ART

In continuous casting of an ingot, titanium or a titanium alloy melted by heating the melt surface by plasma arc melting (PAM) or electron beam melting (EB) is charged into a bottomless mold and pulled out downward while solidifying it.

Patent Document 1 discloses an automatically controlled plasma melting casting method. In the automatically controlled plasma melting casting method, titanium or a titanium alloy is melted by plasma arc in an inert gas atmosphere, charged into a mold, and solidified. Unlike electron beam melting that is performed in vacuum, the plasma arc melting method performed in an inert gas atmosphere described in Patent Document 1 can cast not only pure titanium but also a titanium alloy.

Patent Document 2 discloses an apparatus for melting and continuous casting a high-melting-point metal ingot by an electron beam method. In the melting and continuous casting apparatus descried in Patent Document 2, an ingot is pulled out while rotating its bottom, and among electron beams for irradiation, the melt surface is irradiated while making the density of electron beams incident along the peripheral part of a mold be higher than that in the central part of the mold.

Since the ingot formed of titanium or a titanium alloy is completed as a product through steps of rolling, forging, heat treatment, etc., an ingot having as a large diameter as 800 to 1,200 mm is required for obtaining a product excellent in the mechanical properties such as fatigue strength.

PRIOR ART LITERATURE

Patent Document

Patent Document 1: Japanese Patent No. 3077387
Patent Document 2: JP-A-2009-172665

SUMMARY OF THE INVENTION

Problems that the Invention is to Solve

However, in the case of continuously casting a round ingot having a large diameter by a plasma arc melting method, a plasma torch has a limited heating range. Therefore, in order to melt titanium or a titanium alloy, the melt surface needs to be entirely heated by moving the torch.

Here, in a method for continuously casting a round ingot of titanium (particularly, a titanium alloy), significant component segregation is caused with an increase in the ingot diameter as described below. An irregularity or flaw generated on the surface of the obtained ingot due to significant component segregation works out to a surface defect in the subsequent rolling or forging step. Therefore, in the continuous casting of a large-diameter ingot formed of titanium or a titanium alloy, the component segregation must be reduced to establish an improvement of the casting surface.

The component segregation that becomes significant with an increase in the diameter of an ingot is described below. In order to make the diameter of a round ingot large, as the diameter of the round ingot is increased, the total amount of heat required to be input into the melt surface during continuous casting becomes larger. FIG. 17 shows the relationship between the total amount of heat input into the melt surface and the pool depth of a molten metal pool formed inside of a mold when uniform heat input or gradient heat input is performed in a continuous casting apparatus. As shown in FIG. 17, when the total amount of heat input into the melt surface is increased, the depth at the center of the molten metal pool formed becomes deep. When the depth at the center of the molten metal pool formed becomes deep, component segregation becomes significant, and the heat input amount in the vicinity of the edge of a round mold becomes excessively small. Then, as shown in FIG. 18 showing the relationship between the average heat input amount at the edge and the amount of a shell exposed to the melt surface when uniform heat input or gradient heat input is preformed in a continuous casting apparatus, the amount of a shell exposed to the melt surface is increased, and the growth of an initial solidified shell is accelerated. As a result, the surface profile of the ingot is deteriorated, making the withdrawal casting difficult depending on the case.

On the other hand, in the case of performing gradient heating so as to input a large amount of heat in the vicinity of the edge of a round mold and input a small amount of heat near the central part, it is considered that not only the total amount of heat input into the melt surface is decreased and the depth at the center of the molten metal pool is reduced but also the growth of an initial solidified shell can be suppressed. However, in this case, the following problems arise. FIG. 19 is a cross-sectional view showing the relationship between the average amount of heat input into the melt surface and the pool depth of a molten metal pool formed inside of a mold in a continuous casting apparatus when the total heat input amount is reduced and the heat input amount is concentrated in the vicinity of the edge. As shown in FIG. 19, when the total heat input amount is decreased and the heat input amount is too much concentrated in the vicinity of the edge part, the heat input amount lacks near the central part, causing a problem that the portion near the central part (the portion surrounded by a dashed line shown in FIG. 19) is solidified. FIG. 20 is a cross-sectional view showing the relationship between the average amount of heat input into the melt surface and the pool depth of a molten metal pool formed inside of a mold in a continuous casting apparatus when the total heat input amount is the same but the heat input amount near the central part is increased. As shown in FIG. 20, when the total heat input amount is the same and the heat input amount near the central part (the portion surrounded by a dashed line shown in FIG. 20) is increased, the heat input amount in the vicinity of the edge (the portion surrounded by a dashed line shown in FIG. 20) is decreased, and the growth of an initial solidified shell is accelerated.

FIG. 21 shows the relationship between the heat input amount in the vicinity of the edge of a mold and the heat input amount near the central part of the mold in a continuous casting apparatus when, as described above, the total heat input amount is the same. As shown in FIG. 21, in a continuous casting apparatus of an ingot formed of titanium or a titanium alloy, the total heat input amount, the heat input amount in the vicinity of the edge of a mold, and the heat input amount near the central part of the mold (the range surrounded by a dashed line shown in FIG. 21) are preferably determined so as to suppress the growth of an initial solidified shell and reduce the total heat input amount as much as possible within a region where solidification near the central part can be avoided.

In addition, in the case of continuously casting an ingot having as a large diameter as ϕ800 to 1,200 mm, if only one plasma torch is used for heating the melt surface as shown in FIG. 22A, the torch must move a long distance. In turn, the time from when the plasma torch departs from a predetermined portion (here, the point A) till when it returns to the portion becomes long as shown in FIG. 22B that is a graph of the history of heat input at the point A, and during that time (the range surrounded by a dashed line shown in FIG. 22B), the ingot temperature is significantly reduced. By using a plurality of plasma torches (here, two torches) for heating the melt surface as shown in FIG. 23A, the time for which the plasma torch is separated from the point is shortened as shown in FIG. 23B that is a graph of the history of heat input at the point A, and the reduction in the ingot temperature can be suppressed. However, in the case of using a plurality of plasma torches, if each plasma torch gets too close to every other plasma torch during movement, for example, these plasma torches interfere with each other as shown in FIG. 23A, and the life of the plasma torch may be shortened. Therefore, it is necessary to establish a torch movement pattern enabling a certain distance to be kept between a plurality of plasma torches.

A problem to be solved by the present invention is to provide a continuous casting method of an ingot formed of titanium or a titanium alloy, where an ingot having a good casting face is produced by reducing the component segregation and the life of a plasma torch can be extended by causing no interference of plasma torches with each other.

Means for Solving the Problems

In order to solve the above problems, the continuous casting method of an ingot formed of titanium or a titanium alloy in the present invention, which continuously casts the ingot formed of titanium or a titanium alloy, includes pouring molten titanium or titanium alloy into a top opening of a bottomless mold with a circular cross-sectional shape, pulling the solidified molten metal in the mold downward from the mold, operating a plurality of plasma torches disposed on an upper side of molten metal in the mold such that their centers are located directly vertically above the molten metal in the mold to generate plasma arcs that heat the molten metal in the mold, and moving the plasma torches in a horizontal direction above a melt surface of the molten metal in the mold, along a trajectory located directly vertically above the molten metal in the mold, while keeping a mutual distance between the respective plasma torches such that the plasma torches do not interfere with each other.

According to this, a plurality of plasma torches are moved while keeping a distance not to allow for interference with each other, whereby the movement distance of each plasma torch can be shortened. As a result, an ingot having a good casting surface can be produced by suppressing the reduction in the ingot temperature and reducing the component segregation, and the life of the plasma torch can be extended by causing no interference of plasma torches with each other.

In the continuous casting method of an ingot formed of titanium or a titanium alloy in the present invention, the number of the plasma torches may be 2, and the plasma torches are moved such that when one plasma torch is located on an upper side in the vicinity of an edge of the mold, the other plasma torch may be located near a central part of the mold.

According to this, two plasma torches are used, so that the movement distance of each plasma torch can be shortened and the reduction in the ingot temperature can be suppressed. In addition, each of two plasma torches is moved to be located either on the upper side in the vicinity of the edge of a mold or on the upper side near the central part of the mold, so that the entire melt surface can be heated while causing no interference of two plasma torches with each other. As a result, not only an ingot having a good casting surface can be produced by reducing the component segregation but also the life of the plasma torch can be extended.

In addition, assuming that a radius of the melt surface is R, the plasma torch may be moved to locate its center on a trajectory formed after an inner circumferential arc having a radius of $0<r1<R/2$ from the center of the melt surface and an outer circumferential arc having a radius of $R/2<r2<R$ from a center of the melt surface are connected by a straight line, and a plasma output of the plasma torch during movement in the inner circumferential arc may be controlled to be lower than a plasma output of the plasma torch during movement in the outer circumferential arc.

According to this, the centers of two plasma torches are moved to be located on a trajectory formed after an inner circumferential arc having a radius of $0<r1<R/2$ from the center of the melt surface and an outer circumferential arc having a radius of $R/2<r2<R$ from the center of the melt surface are connected by a straight line, so that the entire melt surface can be heated while causing no interference of two plasma torches with each other. As a result, the life of the plasma torch can be extended. In addition, the plasma output is set high during movement in the outer circumferential arc, and the plasma output is set low during movement in the inner circumferential arc, so that the heat input amount in the vicinity of the edge of a mold can be made large and the heat input amount near the central part of the mold can be made small. In turn, the growth of an initial solidified shell can be suppressed, and the total amount of heat input into the melt surface decreases as compared with the case of uniform heat input. Therefore, the depth of the molten metal pool becomes shallow, and the component segregation can be reduced. As a result, an ingot having a good casting surface can be produced.

In addition, each of the plasma torches may be moved within either one range of two divided semicircles as viewed from a front of the melt surface.

According to this, each plasma torch is moved within either one range of two divided semicircles as viewed from the front of the melt surface, so that trajectories allowing for no interference of two plasma torches with each other can be ensured.

In addition, the movement may be controlled to afford a distance of R/2 or more between centers of the plasma torches.

According to this, the movement is controlled to afford a distance of R/2 or more between centers of the plasma torches, so that a distance allowing for no interference of two plasma torches with each other can be ensured.

Advantage of the Invention

The continuous casting method of an ingot formed of titanium or a titanium alloy in the present invention can produce an ingot having a good casting surface by reducing the component segregation and can extend the torch life.

EMBODIMENTS FOR CARRYING OUT THE INVENTION

Figure 1:
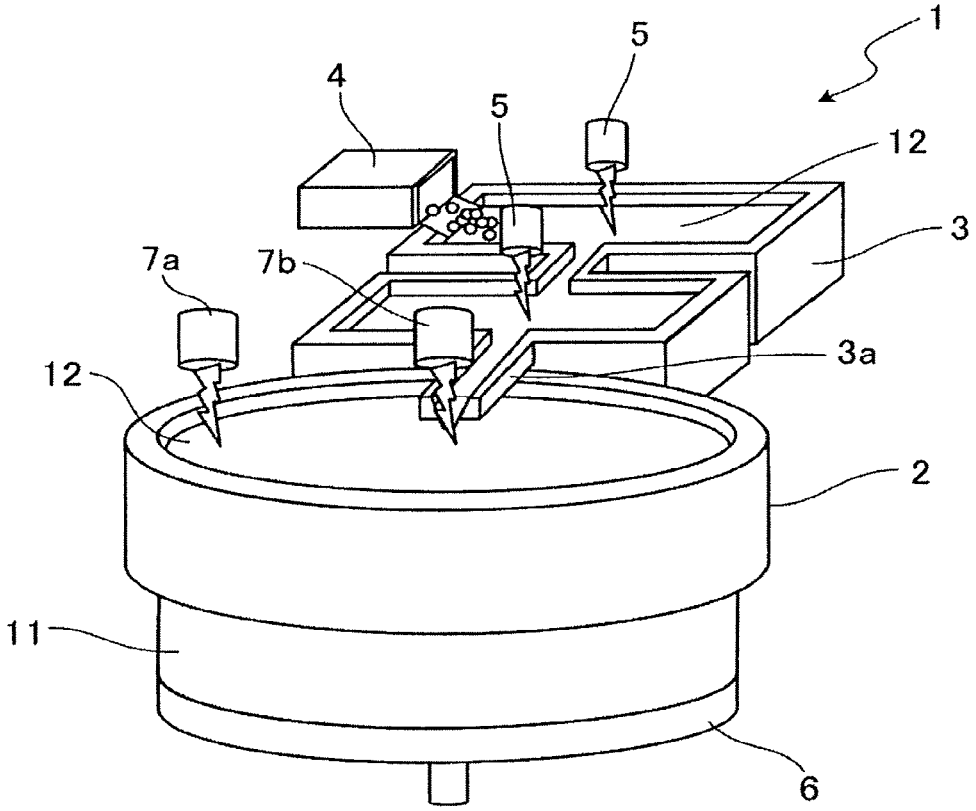
FIG. 1 A perspective view of the continuous casting apparatus according to an embodiment of the present invention.

The embodiments for carrying out the continuous casting method of an ingot formed of titanium or a titanium alloy according to the present invention are described below in line with a specific example by referring to the drawings.

Those described below are merely illustrative and do not indicate application limitations of the continuous casting method of an ingot formed of titanium or a titanium alloy according to the present invention. That is, the continuous casting method of an ingot formed of titanium or a titanium alloy according to the present invention is not limited to the following embodiments, and various changes falling within the scope of claims can be made therein.

(Configuration of Continuous Casting Apparatus)

The continuous casting apparatus of an ingot formed of titanium or a titanium alloy according to an embodiment of the present invention is a continuous casting apparatus where a molten metal obtained by plasma arc melting of titanium or a titanium alloy is poured into a bottomless mold and the molten metal is solidified and the molten metal solidified is pulled out downward, thereby continuously casting an ingot formed of titanium or a titanium alloy. The continuous casting apparatus 1 of an ingot formed of titanium or a titanium alloy for use in an embodiment of the present invention (hereinafter, simply referred to as "continuous casting apparatus") is described based on FIGS. 1 and 2.

Figure 2:
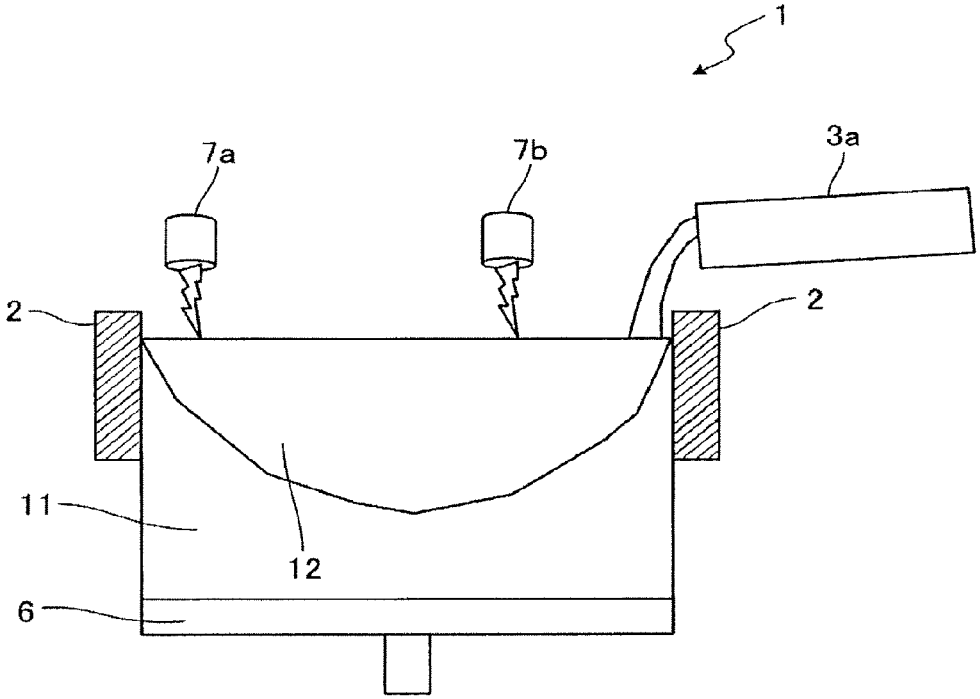
FIG. 2 A cross-sectional view of the mold in the continuous casting apparatus according to an embodiment of the present invention.

As shown in FIG. 1 that is a perspective view of the continuous casting apparatus for use in an embodiment of the present invention and FIG. 2 that is a cross-sectional view of the mold in the continuous casting apparatus for use in an embodiment of the present invention, the continuous casting apparatus 1 includes a mold 2, a cold hearth 3, a raw material charging device 4, a plasma torch 5, a starting block 6, and two plasma torches 7*a* and 7*b*. An inert gas atmosphere such as argon gas or helium gas is made around the continuous casting apparatus 1.

The raw material charging device 4 charges a raw material of titanium or a titanium alloy, such as sponge titanium and scrap, into the cold hearth 3. The plasma torch 5 is disposed on the upper side of the cold hearth 3 and generates a plasma arc to melt the raw material in the cold hearth 3. A molten metal 12 after the melting of raw material in the cold hearth 3 is poured by the cold hearth 3 at a predetermined flow rate into the mold 2 from a melt pouring part 3*a*.

The mold 2 is made of copper and is formed to be bottomless and have an opening at the top (top opening). In addition, the mold 2 is formed so as to have a circular cross-sectional shape having a diameter (ϕ) of 800 to 1,200 mm. Inside of at least a part of the cylindrical wall of the mold 2, a water-cooling mechanism (not shown) for cooling the mold with circulating water is provided so as to prevent damage by the high-temperature molten metal 12 poured.

The starting block 6 is moved up and down by a drive part (not shown) and can close the bottom-side opening of the mold 2. The molten metal 12 poured into the mold 2 starts to be solidified from its surface contacted with the mold 2 of a water cooling type. The starting block 6 closing the bottom-side opening part of the mold 2 is drawn downward at a predetermined speed, whereby an ingot 11 having a cylindrical shape resulting from solidification of the molten metal 12 is continuously cast while being pulled out downward.

Two plasma torches 7*a* and 7*b* are a torch generating a plasma arc and are provided on the upper side of the top-side opening of the mold 2, i.e., on the upper side of the molten metal 12 in the mold 2. The melt surface of the molten metal 12 poured into the mold 2 is irradiated with plasma arcs generated from two plasma torches 7*a* and 7*b*, whereby the molten metal 12 in the mold 2 is heated with plasma arcs. In addition, two plasma torches 7*a* and 7*b* are disposed movably in the horizontal direction.

Here, in the case of electron beam melting in a vacuum atmosphere, casting of a titanium alloy is difficult, because trace components evaporate, but in the case of plasma arc melting in an inert gas atmosphere, not only pure titanium but also a titanium alloy can be cast.

The continuous casting apparatus 1 may include a flux charging device for charging solid-phase or liquid-phase flux onto the melt surface of the molten metal 12 in the mold 2. Here, in the case of electron beam melting in a vacuum atmosphere, charging of flux into the molten metal 12 in the mold 2 is difficult, because the flux scatters. On the other hand, the plasma arc melting in an inert gas atmosphere is advantageous in that the flux can be charged into the molten metal 12 in the mold 2.

Next, the trajectories of movements of two plasma torches 7*a* and 7*b* in the continuous casting apparatus 1 for use in an embodiment of the present invention are described based on FIGS. 3 to 5A and FIG. 5B.

Figure 3:
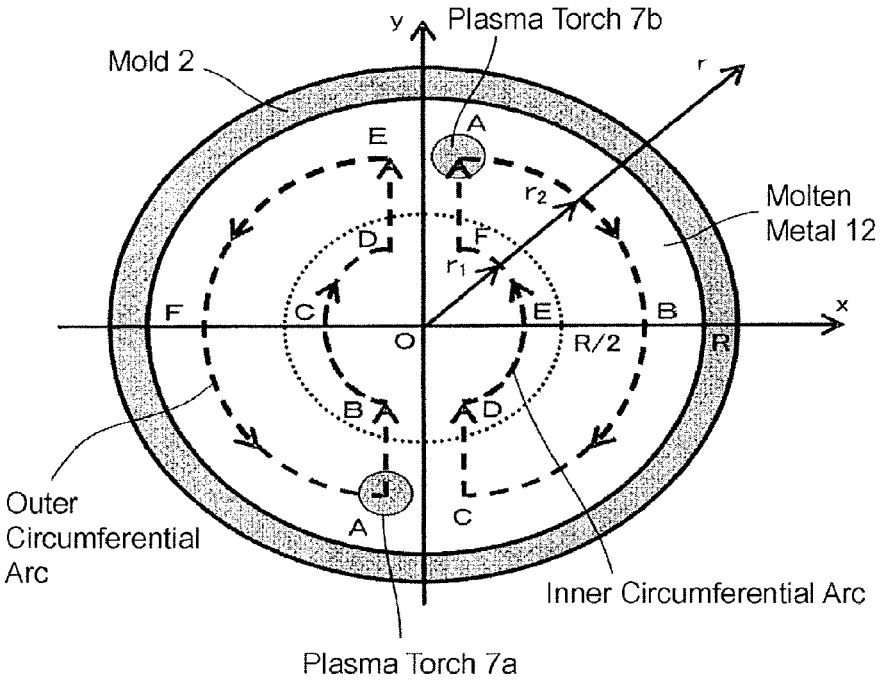
FIG. 3 A front view of the melt surface showing trajectories of movements of two plasma torches in the continuous casting apparatus according to an embodiment of the present invention.
Figure 4A:
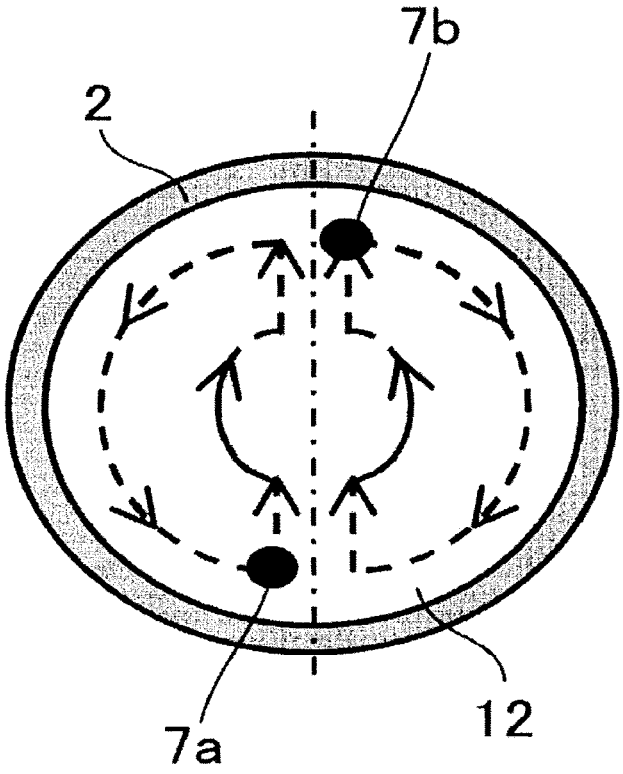
FIG. 4A A front view of the melt surface showing trajectories of movements of two plasma torches in the continuous casting apparatus according to an embodiment of the present invention and the positional relationship therebetween.
Figure 4B:
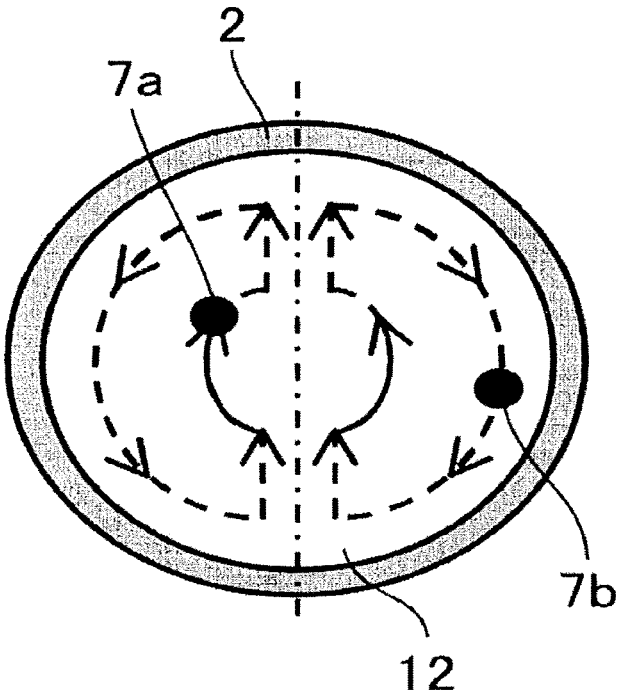
FIG. 4B A front view of the melt surface showing trajectories of movements of two plasma torches in the continuous casting apparatus according to an embodiment of the present invention and the positional relationship therebetween.
Figure 4C:
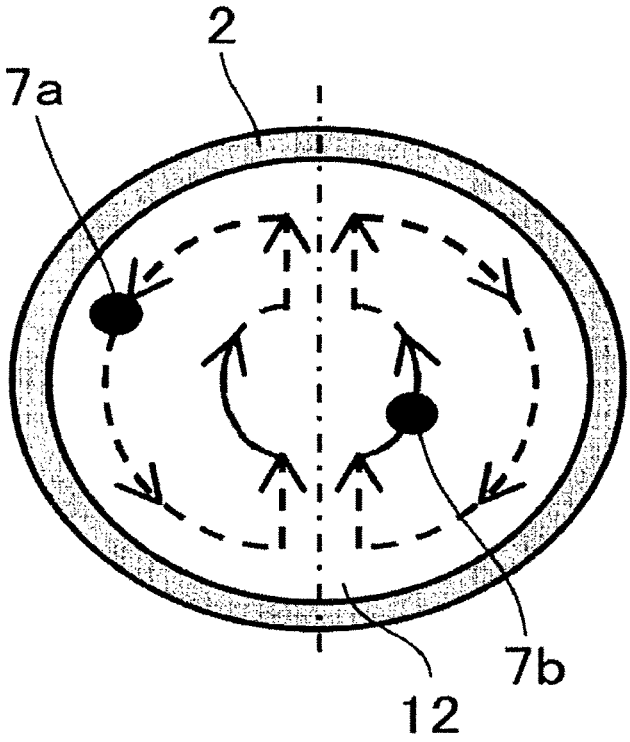
FIG. 4C A front view of the melt surface showing trajectories of movements of two plasma torches in the continuous casting apparatus according to an embodiment of the present invention and the positional relationship therebetween.
Figure 4D:
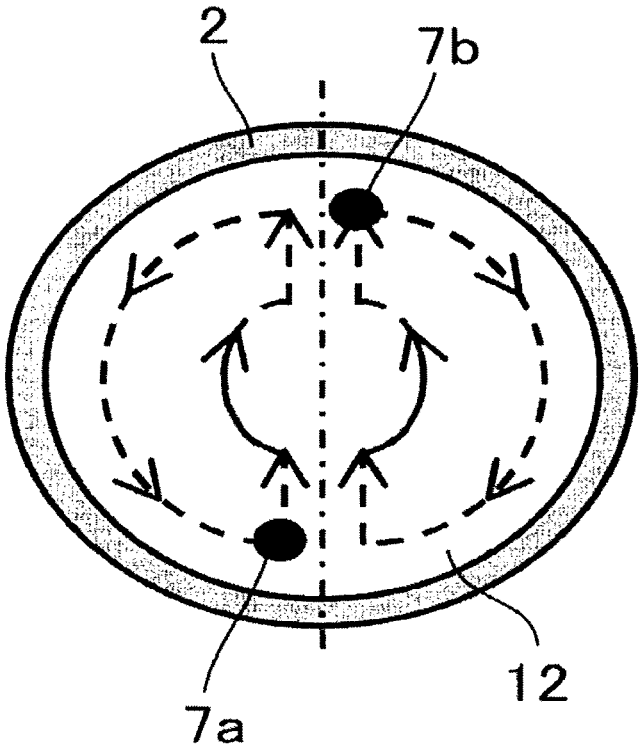
FIG. 4D A front view of the melt surface showing trajectories of movements of two plasma torches in the continuous casting apparatus according to an embodiment of the present invention and the positional relationship therebetween.

As shown in FIG. 3 that is a front view of the melt surface showing trajectories of movements of two plasma torches 7*a* and 7*b*, assuming that when the molten metal 12 is viewed from the front of the melt surface, the center O of the molten metal 12 in the mold 2 is an origin and the melt surface perpendicular to the central axis of the molten metal 12 is an xy plane, two plasma torches 7*a* and 7*b* are controlled so that respective centers can move in the following ranges:

Range of plasma torch 7*a*: the range of $x<0$ (left semicircle in FIG. 3)

Range of plasma torch 7*b*: the range of $x>0$ (right semicircle in FIG. 3)

When the radius of the molten metal 12 (i.e., ingot 11) is assumed to be R, the plasma torches 7*a* and 7*b* are controlled so that respective centers can trace the following trajectories during movement in the direction of A→B→C→D→E→F:

Inner circumferential arc having a radius of $0<r1<R/2$: B→C→D for the plasma torch 7*a*, and D→E→F for the plasma torch 7*b*

Outer circumferential arc having a radius of $R/2<r2<R$: E→F→A for the plasma torch 7*a*, and A→B→C for the plasma torch 7*b*

Straight line connecting two arcs, i.e., inner circumferential arc and outer circumferential arc: A→B and D→E for the plasma torch 7*a*, and C→D and F→A for the plasma torch 7*b*

That is, the plasma torch 7*a* is controlled so that its center can trace the following trajectories:

A→B: straight line connecting two arcs, i.e., inner circumferential arc and outer circumferential arc B→C→D: inner circumferential arc D→E: straight line connecting two arcs, i.e., inner circumferential arc and outer circumferential arc E→F→A: outer circumferential arc In addition, the plasma torch 7*b* is controlled so that its center can trace the following trajectories:

A→B→C: outer circumferential arc

Figure 5A:
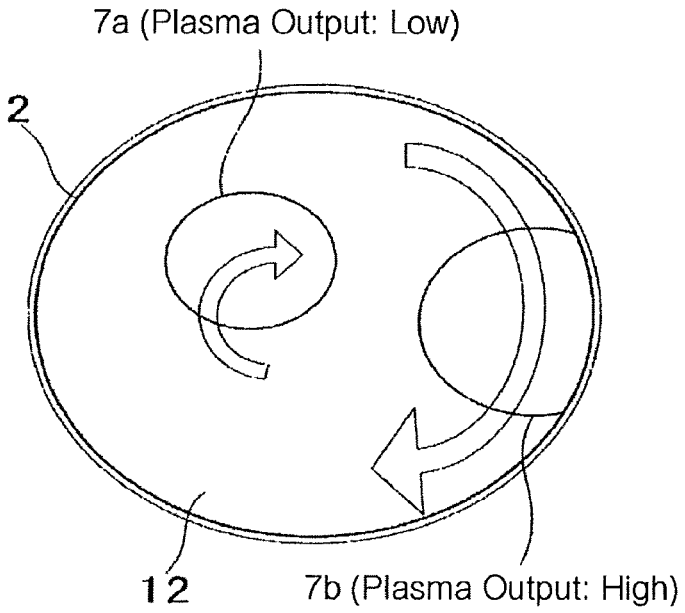
FIG. 5A A front view of the melt surface showing the relationship between trajectories of movements of two plasma torches and plasma outputs in the continuous casting apparatus according to an embodiment of the present invention.
Figure 5B:
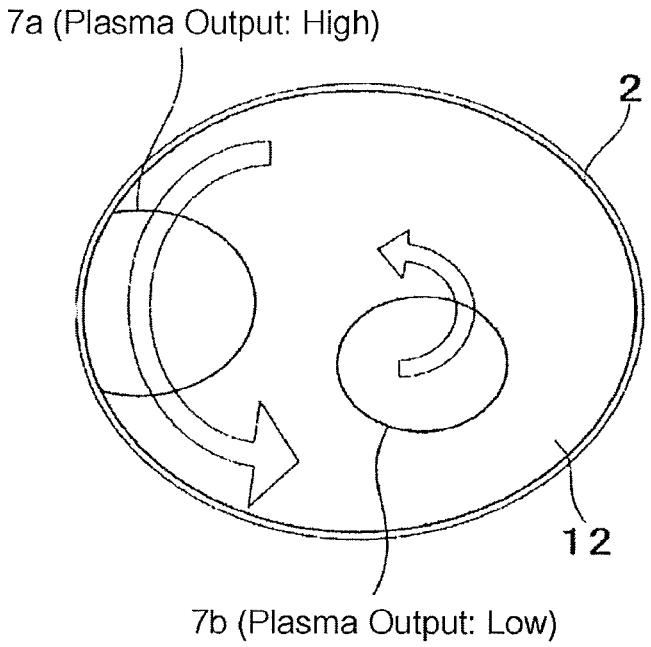
FIG. 5B A front view of the melt surface showing the relationship between trajectories of movements of two plasma torches and plasma outputs in the continuous casting apparatus according to an embodiment of the present invention.

C→D: straight line connecting two arcs, i.e., inner circumferential arc and outer circumferential arc D→E→F: inner circumferential arc F→A: straight line connecting two arcs, i.e., inner circumferential arc and outer circumferential arc As shown in FIGS. 5A and 5B that are front views of the melt surface each showing the relationship between trajectories of movements of two plasma torches 7*a* and 7*b* and plasma outputs, the plasma torches 7*a* and 7*b* are controlled to give a high torch output when each center moves in the outer circumferential arc and give a low torch output when each center moves in the inner circumferential arc. This can make the heat input amount in the vicinity of the edge of the mold 2 large and make the heat input amount near the central part small. As a result, the growth of an initial solidified shell can be suppressed. Furthermore, the total amount of heat input into the melt surface decreases as compared with uniform heat input and therefore, the depth of the molten metal pool becomes shallow, so that the component segregation can be reduced.

As shown in FIGS. 4A to 4D that are front views of the melt surface each showing trajectories of movements of two plasma torches 7*a* and 7*b* and the positional relationship therebetween, respective centers of the plasma torches 7*a* and 7*b* move in the direction of A→B→C→D→E→F. It is found that thanks to such movements, the plasma torches 7*a* and 7*b* can keep a distance of R/2 or more between torch centers (hereinafter, simply referred to as "torch-to-torch distance"). It is also found that when either one of the plasma torches 7*a* and 7*b* moves in the inner circumferential arc, the other plasma torch 7*a* or 7*b* is controlled to be located on the outer circumferential arc.

Next, the simulation results of component segregation that is caused when an ingot is continuously cast using the continuous casting apparatus 1 for use in an embodiment of the present invention are discussed by referring to FIGS. 6 to 10.

Figure 6:
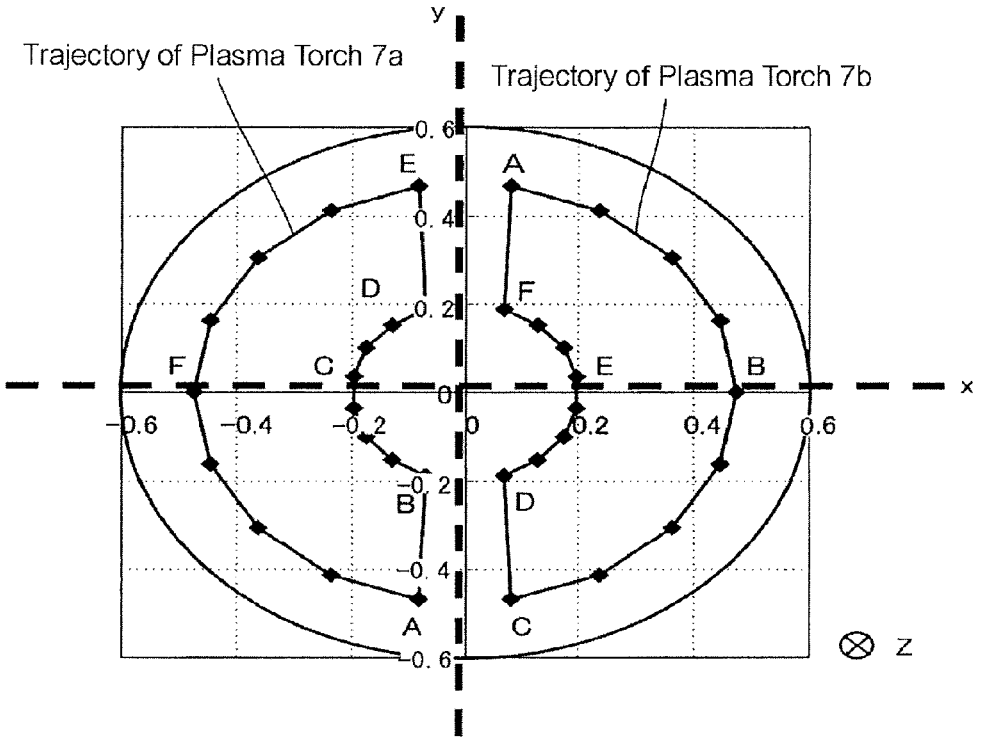
FIG. 6 A front view of the melt surface showing coordinates of the trajectories of movements of two plasma torches in the continuous casting apparatus according to an embodiment of the present invention.

In the simulation according to an embodiment of the present invention, the material of the ingot was Ti-6Al-4V, the size of the mold 2 (i.e., the radius R of the melt surface of the molten metal 12) was 600 mm, and the amount of the raw material melted was 1.3 ton/hour. In addition, as viewed from the front of the melt surface (i.e., from the top-side opening of the mold 2), the coordinates of trajectories of movements of two plasma torches 7*a* and 7*b* are as shown in FIG. 6 when expressed on xy coordinate axes with the origin being fixed at the center of the melt surface. Here, in the trajectories of the plasma torches 7*a* and 7*b* shown in FIG. 6, the radius r1 of the inner circumferential arc is 200 mm, and the radius r2 of the outer circumferential arc is 450 mm. Furthermore, each of the plasma torches 7*a* and 7*b* moves in the direction of A→B→C→D→E→F, and the moving speed is 50 mm/sec. In each of the plasma torches 7*a* and 7*b*, the plasma output during movement in the inner circumferential arc is 200 kW, and the plasma output during movement in the outer circumferential arc is 750 kW.

Figure 7:
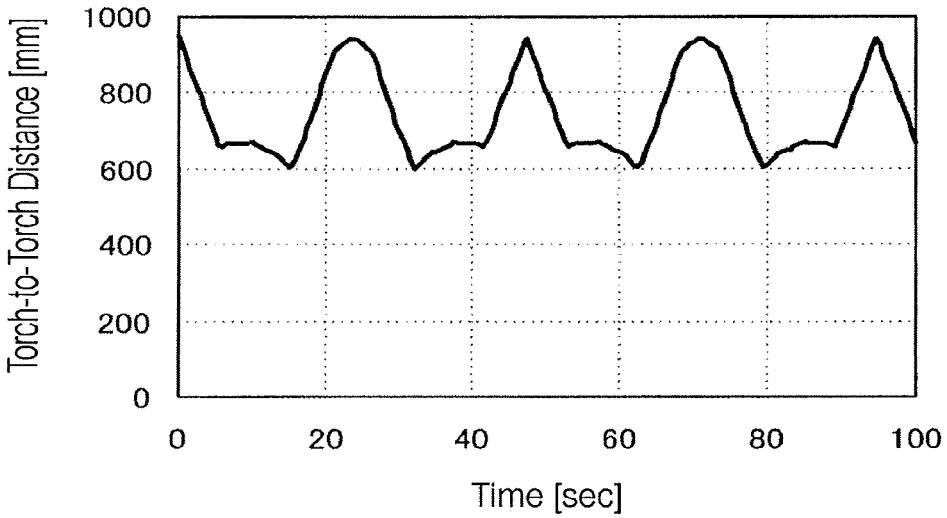
FIG. 7 A graph showing the torch-to-torch distance when two plasma torches in the continuous casting apparatus according to an embodiment of the present invention move along the trajectories shown in FIG. 6.

It is found from the graph showing the history of torch-to-torch distance in FIG. 7 that the torch-to-torch distance of the plasma torches 7*a* and 7*b* moving based on the trajectories shown in FIG. 6 is 600 mm or more. That is, it is found that in this simulation, the torch-to-torch distance of the plasma torches 7*a* and 7*b* can ensure a distance of R/2 or more, in which R is radius of melt surface of molten metal 12.

Figure 8:
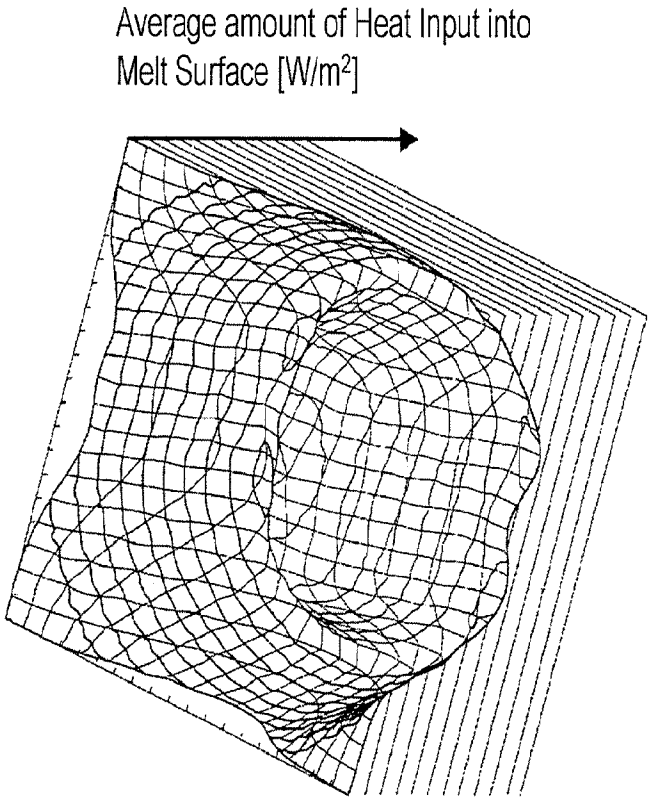
FIG. 8 A perspective view of the melt surface showing the average amount of heat input into the melt surface when two plasma torches in the continuous casting apparatus according to an embodiment of the present invention move along the trajectories shown in FIG. 6.
Figure 9:
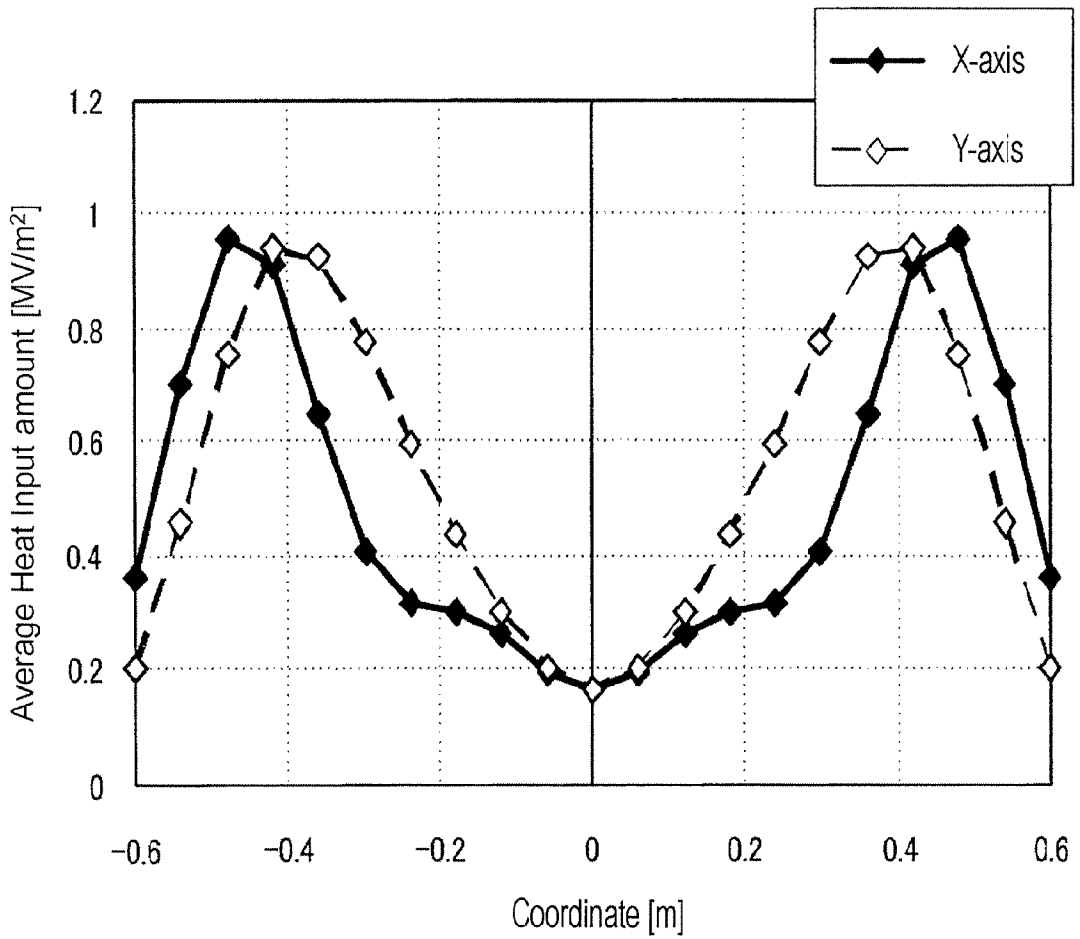
FIG. 9 A graph showing the relationship between the coordinates of the average heat input amount (time average) as viewed from the directions of xy coordinate axes and the average amount of heat input into the melt surface when two plasma torches in the continuous casting apparatus according to an embodiment of the present invention move along the trajectories shown in FIG. 6.

In addition, as seen from FIG. 8 showing the average amount of heat input into the melt surface (time average) of the molten metal 12 during movements of plasma torches 7*a* and 7*b* based on the trajectories shown in FIG. 6, and FIG. 9 showing the average heat input amount (time average) as viewed from the x-axis and y-axis directions (see, FIG. 6) during movements of plasma torches 7*a* and 7*b* based on the trajectories shown in FIG. 6, gradient heating with a high heat input amount in the vicinity of the edge of the mold 2 and a low heat input amount in the central part of the mold 2 can be realized.

Figure 10:
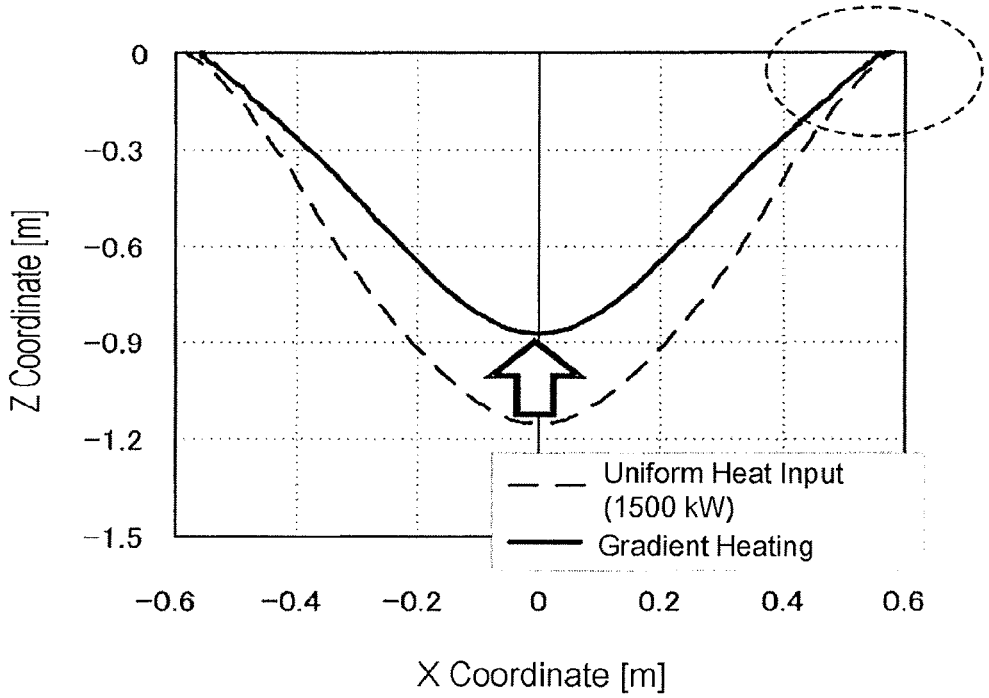
FIG. 10 A graph showing the relationship between the coordinates and the pool depth in the case of performing gradient heating or uniform heat input when two plasma torches in the continuous casting apparatus according to an embodiment of the present invention move along the trajectories shown in FIG. 6.

Furthermore, the results of a simulation of measuring the pool depth of the molten metal pool (i.e., the value of z coordinate relative to x coordinate when y=0) formed inside of the mold 2, which is performed for a case where while moving plasma torches 7*a* and 7*b* based on the trajectories shown in FIG. 6, gradient heating is conducted by setting the plasma output during movement in the inner circumferential arc to 200 kW and the plasma output during movement in the outer circumferential arc to 750 kW as described above and for a case where uniform heat input with a constant plasma output of 1,500 kW is conducted, are shown in FIG. 10. As shown in FIG. 10, the pool depth in the case of gradient heating is 873 mm, and the pool depth in the case of uniform heat input is 1,150 mm, revealing that the pool depth is reduced when gradient heating is conducted. In addition, in the case of gradient heating and in the case of uniform heat input, a pool depth is obtained in the vicinity of the edge of the mold 2 (near 0.6 m and near −0.6 m of the x coordinate axis, surrounded by a dashed line shown in FIG. 10) and therefore, it is found that melting can proceed up to the vicinity of the edge of the mold 2 and the growth of a shell can be suppressed.

Figure 11:
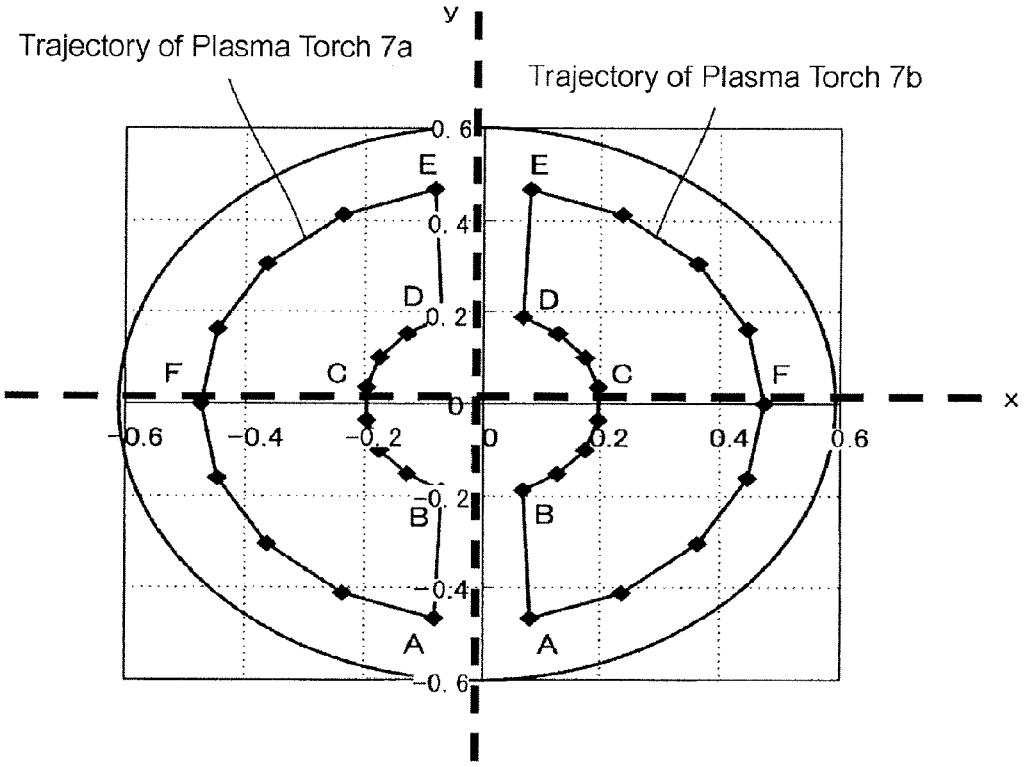
FIG. 11 A front view of the melt surface showing the coordinates of trajectories of movements of two plasma torches in Comparative Example 1.
Figure 12A:
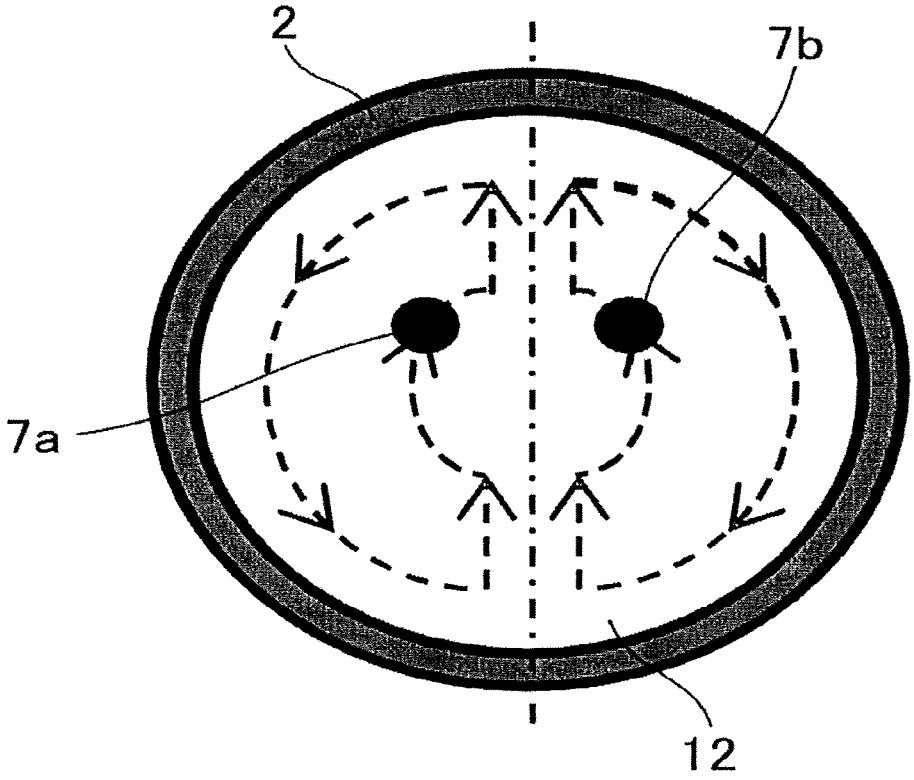
FIG. 12A A front view of the melt surface showing trajectories of movements of two plasma torches in Comparative Example 1 and the positional relationship therebetween.
Figure 12B:
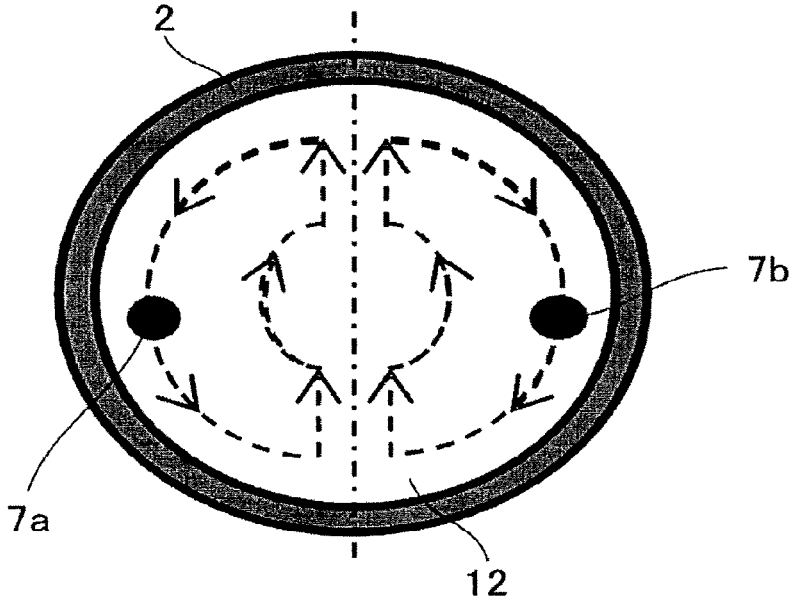
FIG. 12B A front view of the melt surface showing trajectories of movements of two plasma torches in Comparative Example 1 and the positional relationship therebetween.
Figure 13:
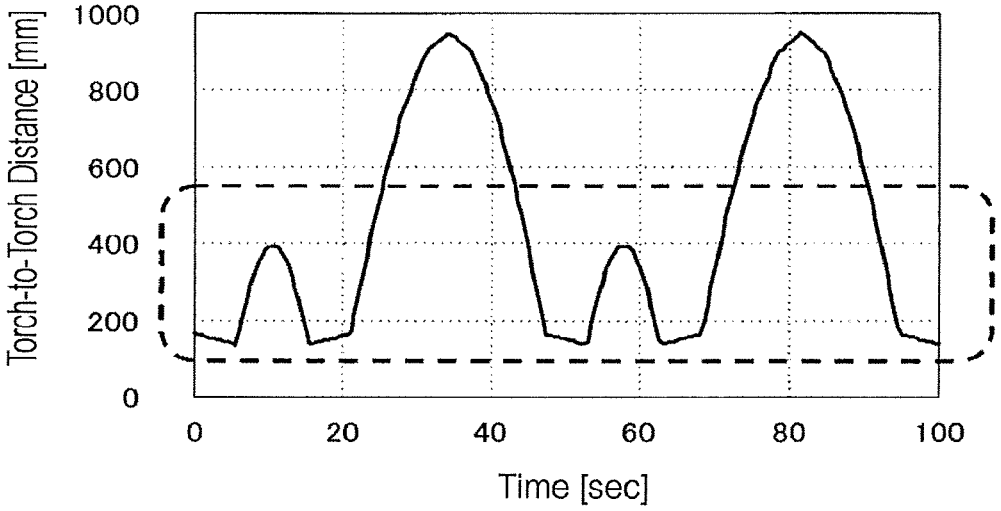
FIG. 13 A graph showing the torch-to-torch distance when two plasma torches in Comparative Example 1 move along the trajectories shown in FIGS. 12A and 12B.

Next, in comparison with the above-described continuous casting apparatus 1 for use in an embodiment of the present invention, the simulation results of Comparative Example 1 where two plasma torches are moved on trajectories different from the trajectories shown in FIG. 6, are described based on FIGS. 11 to 13.

In the simulation of Comparative Example 1, the conditions regarding the material of the ingot, the size of the mold 2, and the amount of the raw material melted are the same as in the above-described simulation according to an embodiment of the present invention, and only the trajectories of two plasma torches are changed. In addition, as viewed from the front of the melt surface (i.e., from the top-side opening of the mold 2), the coordinates of trajectories of movements of two plasma torches 7*a* and 7*b* are as shown in FIG. 11 when expressed on xy coordinate axes with the origin being fixed at the center of the melt surface. Here, in the trajectories of the plasma torches 7*a* and 7*b*, the radius r1 of the inner circumferential arc is 200 mm, and the radius r2 of the outer circumferential arc is 450 mm.

Furthermore, in the case where each of the plasma torches 7*a* and 7*b* moves in the direction of A→B→C→D→E→F and the moving speed is 50 mm/sec, in Comparative Example 1, two plasma torches 7*a* and 7*b* move based on trajectories and positional relationship shown in FIGS. 12A and 12B.

As shown in FIGS. 12A and 12B, it is found that two plasma torches 7*a* and 7*b* are simultaneously located on the inner circumferential arc or outer circumferential arc. In addition, as shown in FIG. 13, the torch-to-torch distance of plasma torches 7*a* and 7*b* moving based on the trajectories shown in FIGS. 11, 12A and 12B becomes R/2 (300 mm) or less, in which R is radius of melt surface of molten metal 12, when both of two plasma torches 7*a* and 7*b* are located on the inner circumferential trajectory (the time when the torch-to-torch distance is included in the range surrounded by a dashed line shown in FIG. 13). Thus, it is found that plasma torches 7*a* and 7*b* may interfere with each other.

Figure 14:
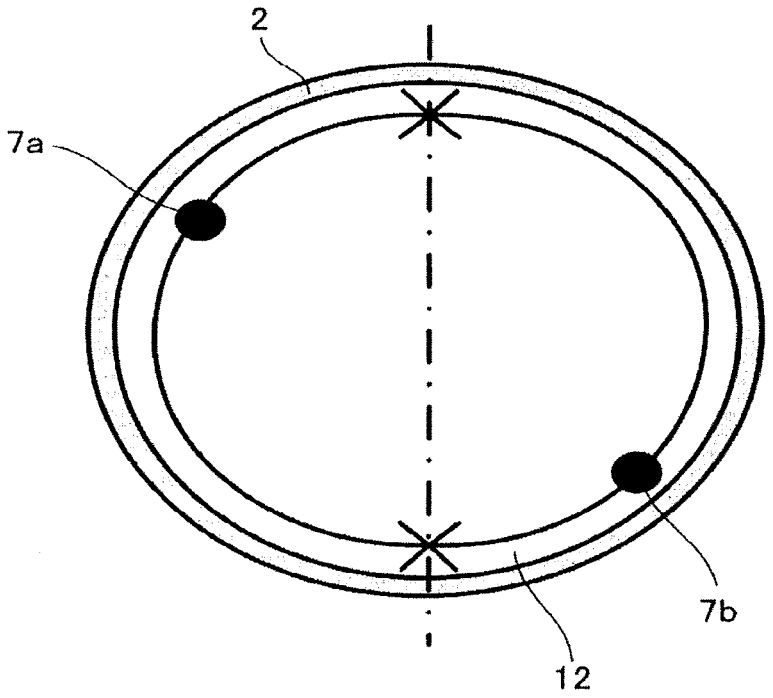
FIG. 14 A front view of the melt surface showing trajectories of movements of two plasma torches in Comparative Example 2 and the positional relationship therebetween.
Figure 15:
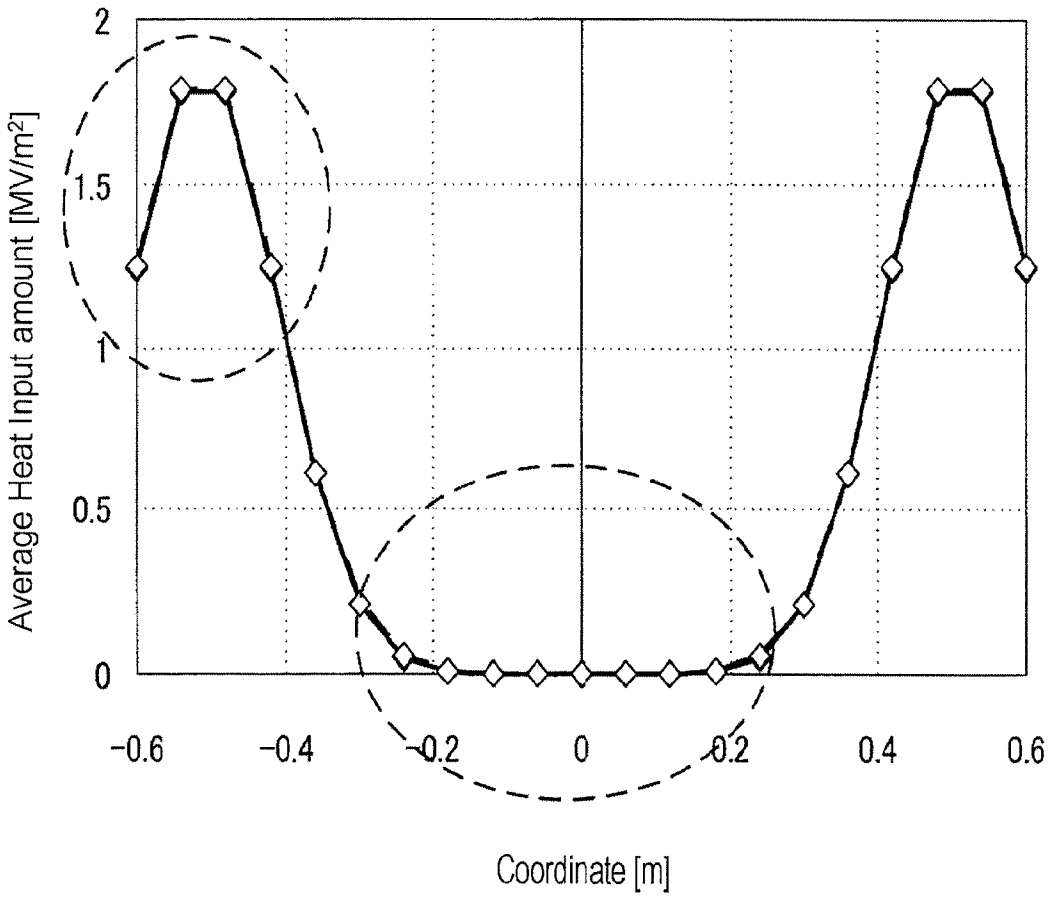
FIG. 15 A graph showing the relationship between the coordinates and the average amount of heat input into the melt surface when two plasma torches in Comparative Example 2 move along the trajectory shown in FIG. 14.
Figure 16:
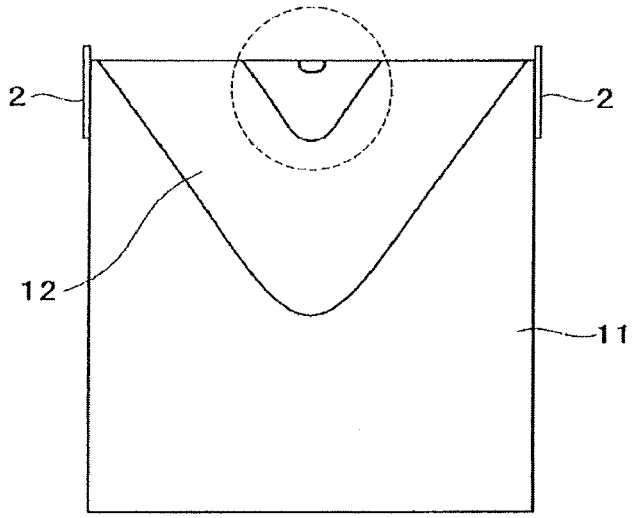
FIG. 16 A cross-sectional view showing the pool depth of a molten metal pool formed inside of a mold when two plasma torches in Comparative Example 2 move along the trajectory shown in FIG. 14.
Figure 17:
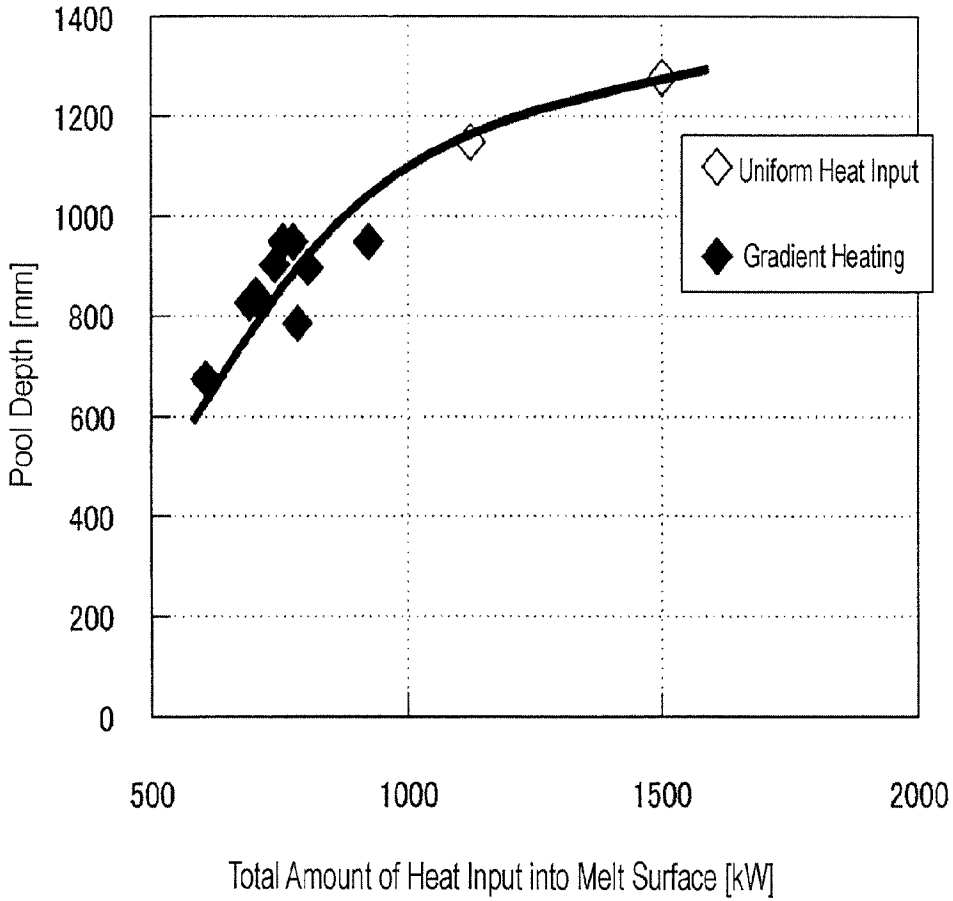
FIG. 17 A graph showing the relationship between the total amount of heat input into the melt surface and the pool depth of a molten metal pool formed inside of a mold when uniform heat input or gradient heat input is performed in a continuous casting apparatus.
Figure 18:
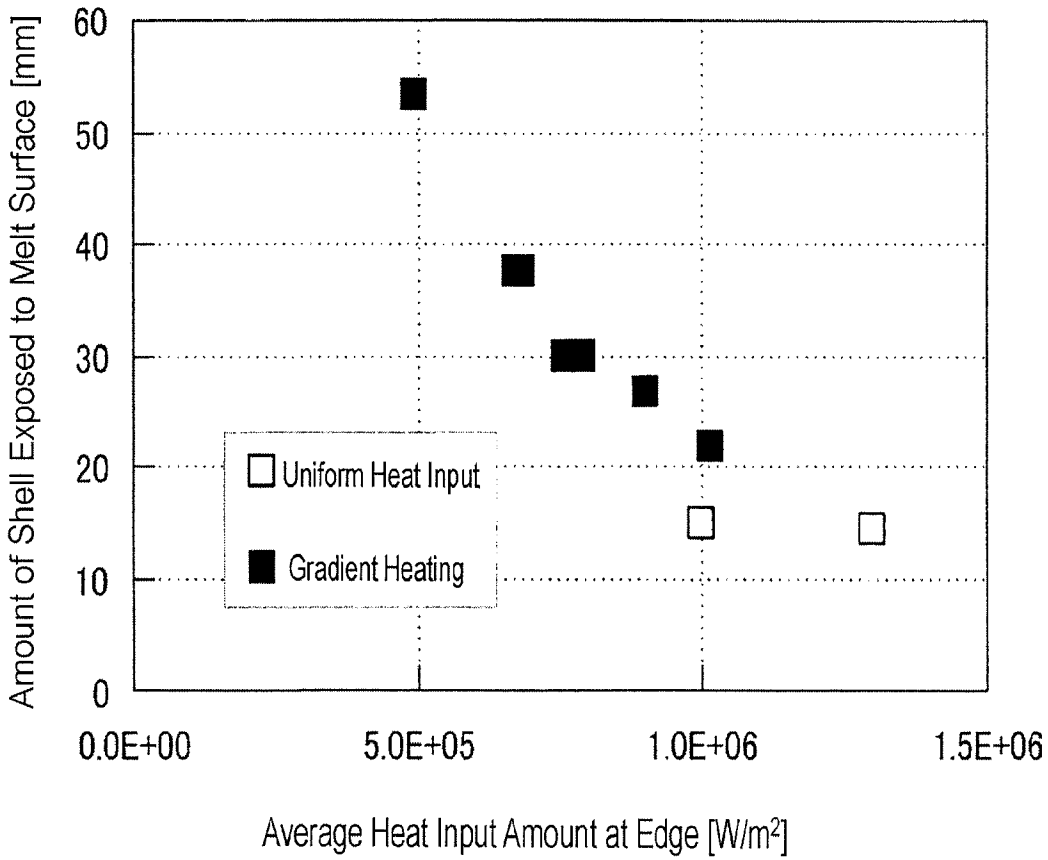
FIG. 18 A graph showing the relationship between the average heat input amount at the edge and the amount of a shell exposed to the melt surface when uniform heat input or gradient heat input is preformed in a continuous casting apparatus.
Figure 19:
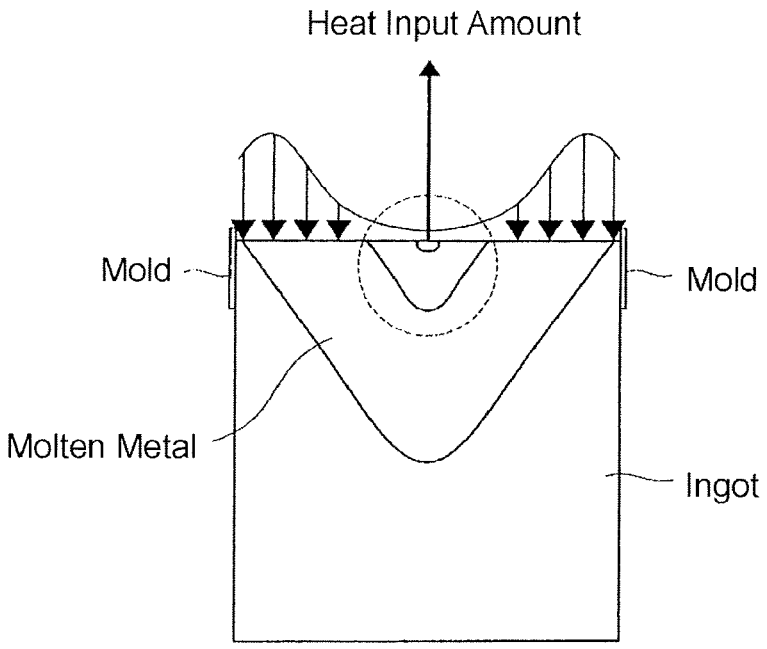
FIG. 19 A cross-sectional view showing the relationship between the average amount of heat input into the melt surface and the pool depth of a molten metal pool formed inside of a mold in a continuous casting apparatus when the total heat input amount is reduced and the heat input amount is concentrated in the vicinity of the edge.
Figure 20:
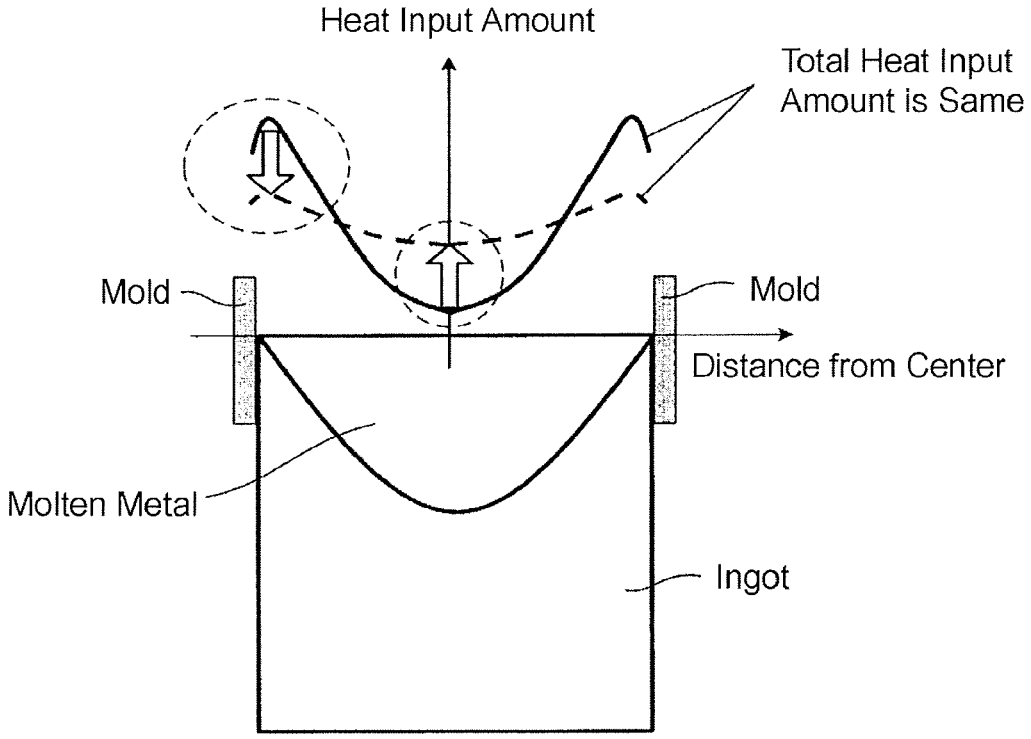
FIG. 20 A cross-sectional view showing the relationship between the average amount of heat input into the melt surface and the pool depth of a molten metal pool formed inside of a mold in a continuous casting apparatus when the total heat input amount is the same but the heat input amount near the central part is increased.
Figure 21:
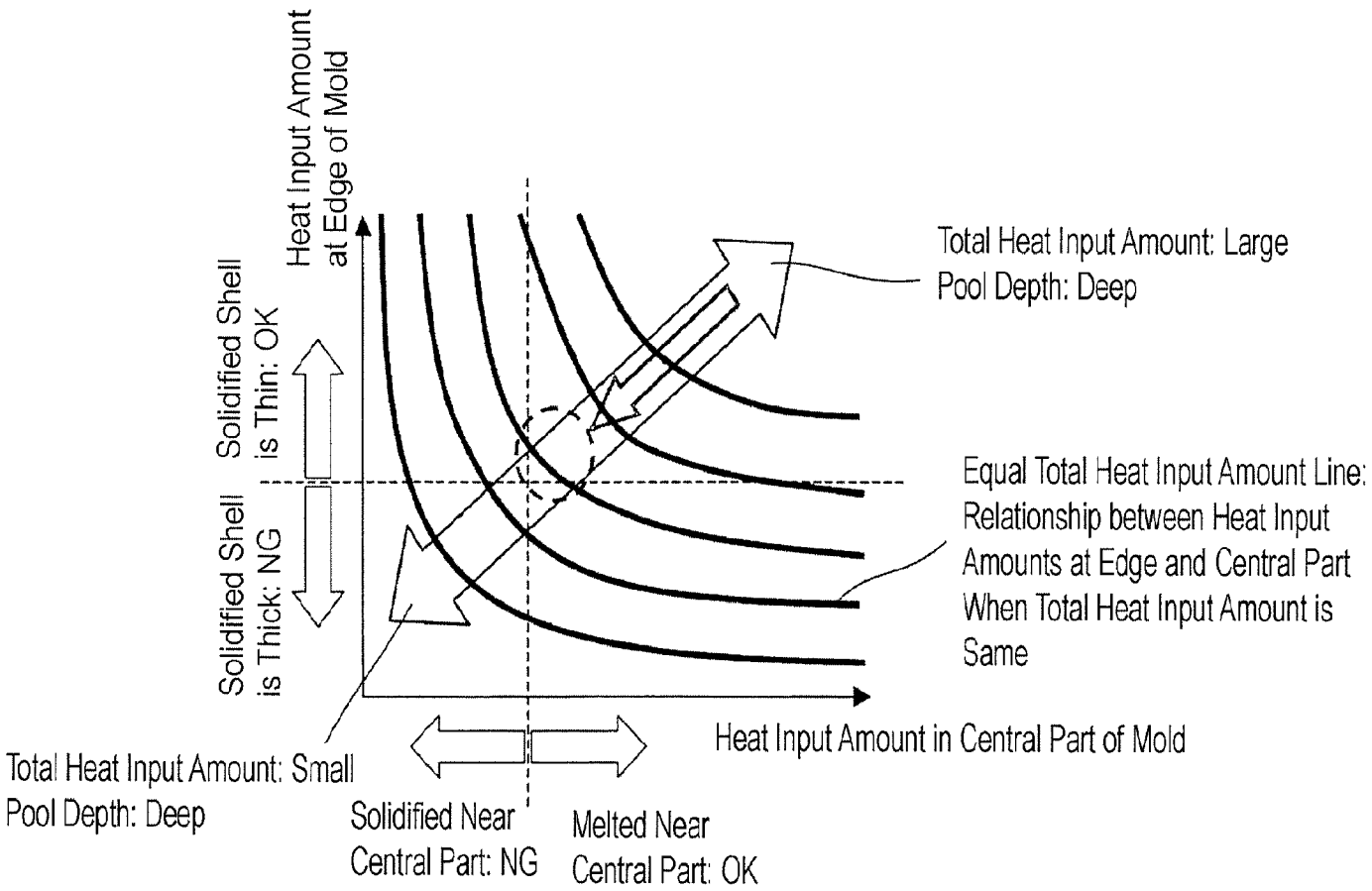
FIG. 21 A graph showing the relationship between the heat input amount in the vicinity of the edge of a mold and the heat input amount near the central part of the mold in a continuous casting apparatus when the total heat input amount is the same.
Figure 22A:
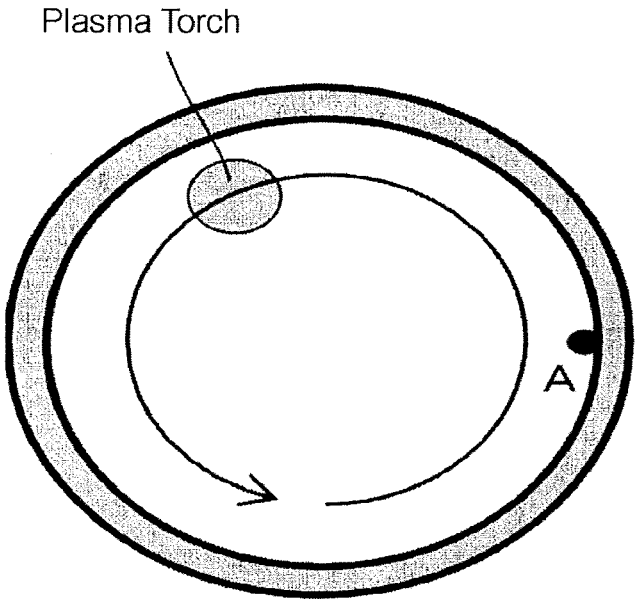
FIG. 22A A front view of the melt surface showing the trajectory of the center of a plasma torch in the case of using one plasma torch.
Figure 22B:
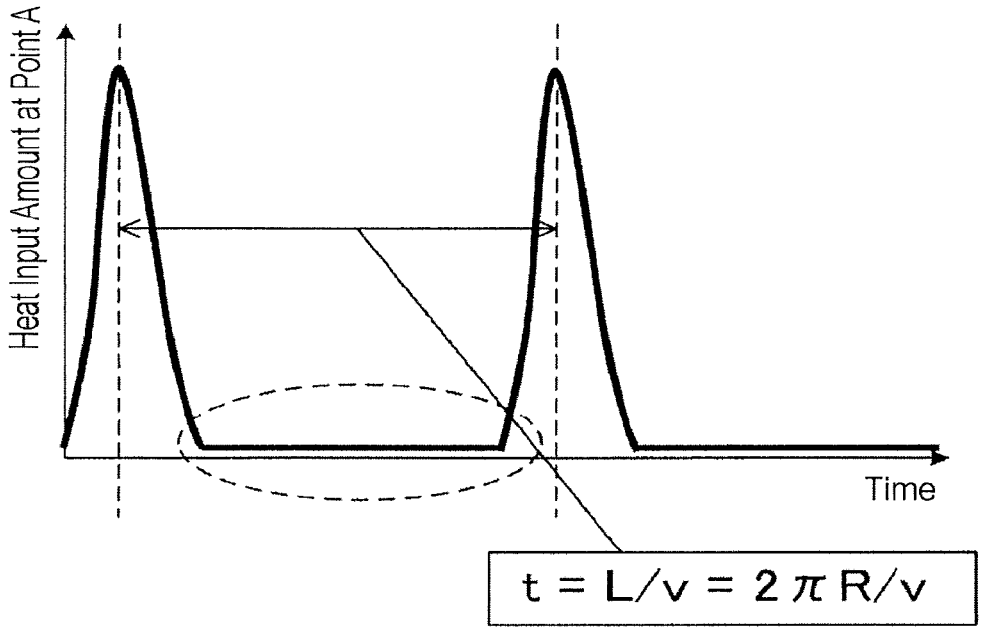
FIG. 22B A graph showing the history of heat input amount at the point A in the case of using one plasma torch.
Figure 23A:
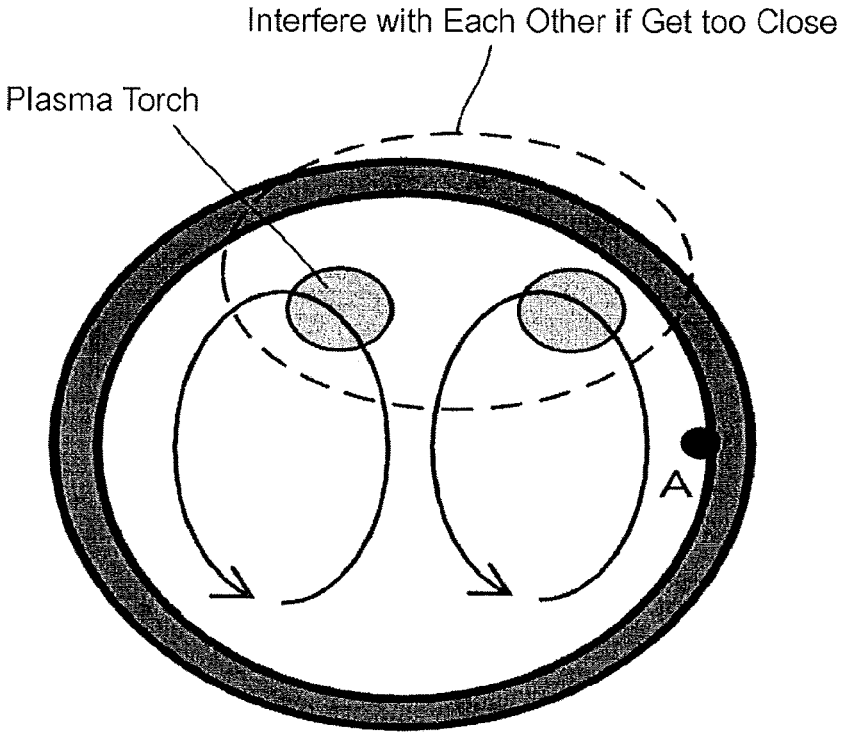
FIG. 23A A front view of the melt surface showing trajectories of the centers of plasma torches in the case of using two plasma torches.
Figure 23B:
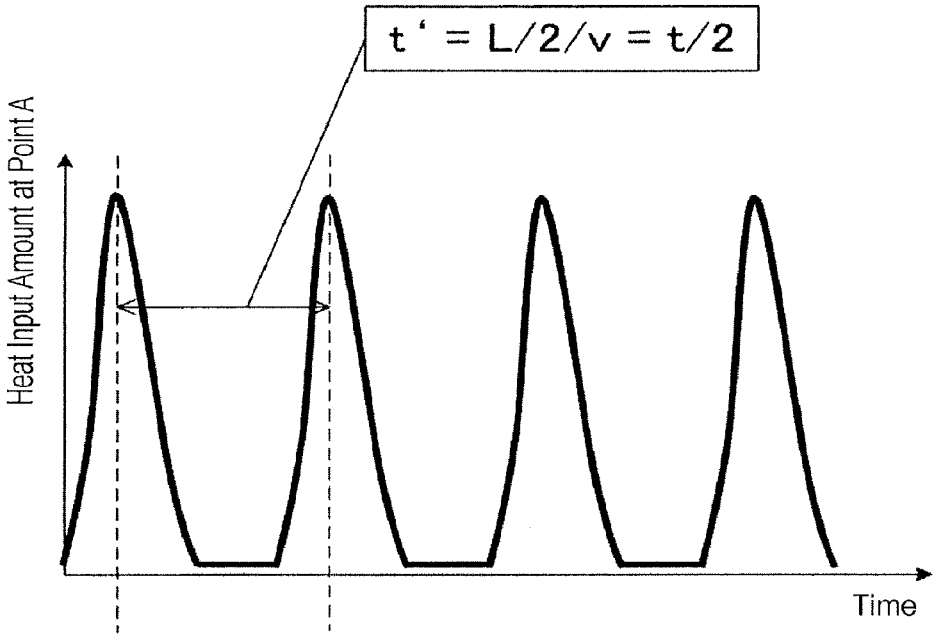
FIG. 23B A graph showing the history of heat input amount at the point A in the case of using two plasma torches.

Next, in comparison with the above-described continuous casting apparatus 1 for use in an embodiment of the present invention, the simulation results of Comparative Example 2 where two plasma torches are moved on trajectories different from the trajectories shown in FIG. 6, are described based on FIGS. 14 to 16.

In the simulation of Comparative Example 2, the conditions regarding the material of the ingot, the size of the mold 2, and the amount of the raw material melted were the same as in the above-described simulation according to an embodiment of the present invention, and only the trajectories and plasma outputs of two plasma torches were changed. In addition, as viewed from the front of the melt surface (i.e., from the top-side opening of the mold 2), the trajectories of movements of two plasma torches 7*a* and 7*b* are as shown in FIG. 14. As shown in FIG. 14, two plasma torches 7*a* and 7*b* move only in the outer circumferential arc and do not move in the inner circumferential arc. That is, two plasma torches 7*a* and 7*b* heat only the outer circumferential arc but do not heat the inner circumferential arc. Here, in the trajectories of plasma torches 7*a* and 7*b*, the radius r2 of the outer circumferential arc is 525 mm.

The moving speed of each of the plasma torches 7*a* and 7*b* is 50 mm/sec. In addition, the plasma output of each of the plasma torches 7*a* and 7*b* is constantly 1,000 kW.

As seen from FIG. 15 showing the average amount of heat input into the melt surface (time average) of the molten metal 12 during movements of plasma torches 7*a* and 7*b* based on the trajectory shown in FIG. 14, heating is excessively concentrated in the vicinity of the edge of the mold 2 and the heat input amount in the central part of the mold 2 is zero, as shown by dashed lines in the Figure. The coordinates in FIG. 15 are obtained by, similarly to FIGS. 6 and 11, expressing the coordinates of trajectories of movements of two plasma torches 7*a* and 7*b* shown in FIG. 14 on xy coordinate axes with the origin being fixed at the center of the melt surface, as viewed from the front of the melt surface (i.e., from the top-side opening of the mold 2).

Furthermore, the results of a simulation of measuring the pool depth of the molten metal pool formed inside of the mold 2, with the heat input amount in the mold 2 being shown by a cross-sectional view, which is performed for a case where while moving plasma torches 7*a* and 7*b* based on the trajectory shown in FIG. 14, uniform heat input is conducted by setting the plasma output during movement in the outer circumferential arc to be constantly 1,000 kW as described above, are shown in FIG. 16. It is found that, as shown by a dashed line in FIG. 16, the heat input amount lacks in the central part of the mold 2 to cause solidification.

As described above, in the continuous casting apparatus of an ingot formed of titanium or a titanium alloy for use in an embodiment of the present invention, two plasma torches 7*a* and 7*b* are used, so that the movement distance of each plasma torch 7*a* or 7*b* can be shortened and reduction in the ingot temperature can be suppressed. In addition, each of two plasma torches 7*a* and 7*b* is moved to be located either on the upper side in the vicinity of the edge of a mold 2 or on the upper side near the central part of the mold 2, so that the entire melt surface can be heated without causing interference of two plasma torches 7*a* and 7*b* with each other.

Furthermore, the centers of two plasma torches 7*a* and 7*b* are moved to be located on trajectories formed after an inner circumferential arc having a radius of $0<r1<R/2$ from the center of the melt surface and an outer circumferential arc having a radius of $R/2<r2<R$ from the center of the melt surface are connected by a straight line, so that the entire melt surface can be heated without causing interference of two plasma torches 7*a* and 7*b* with each other. As a result, the life of the torch can be extended. In addition, the plasma output is set high when the plasma torches 7*a* and 7*b* move in the outer circumferential arc, and the plasma output is set low during movement in the inner circumferential arc, so that the heat input amount in the vicinity of the edge of a mold 2 can be made large and the heat input amount near the central part of the mold 2 can be made small. In turn, the growth of an initial solidified shell can be suppressed, and the total amount of heat input into the melt surface decreases as compared with uniform heat input. Therefore, the depth of the molten metal pool becomes shallow, and the component segregation can be reduced.

As a result, in the continuous casting method of an ingot formed of titanium or a titanium alloy according to an embodiment of the present invention, an ingot 11 having a good casting surface can be produced by reducing the component segregation and the lives of plasma torches 7*a* and 7*b* can be extended by causing no interference of plasma torches 7*a* and 7*b* with each other.

In the foregoing pages, the present invention has been described with reference to preferred embodiments thereof, but the present invention is not limited to these embodiments, and various changes falling within the scope of claims can be made therein.

In the above-described continuous casting method of an ingot formed of titanium or a titanium alloy according to an embodiment of the present invention, with respect to trajectories of movements of two plasma torches 7*a* and 7*b*, assuming that when the molten metal 12 is viewed from the front of the melt surface, the center of the molten metal 12 in the mold 2 is an origin and the melt surface perpendicular to the central axis of the molten metal 12 is an xy plane, two plasma torches 7*a* and 7*b* are controlled so that each center can move in the range of $x<0$ or $x>0$, but the present invention is not limited thereto.

Figure 24:
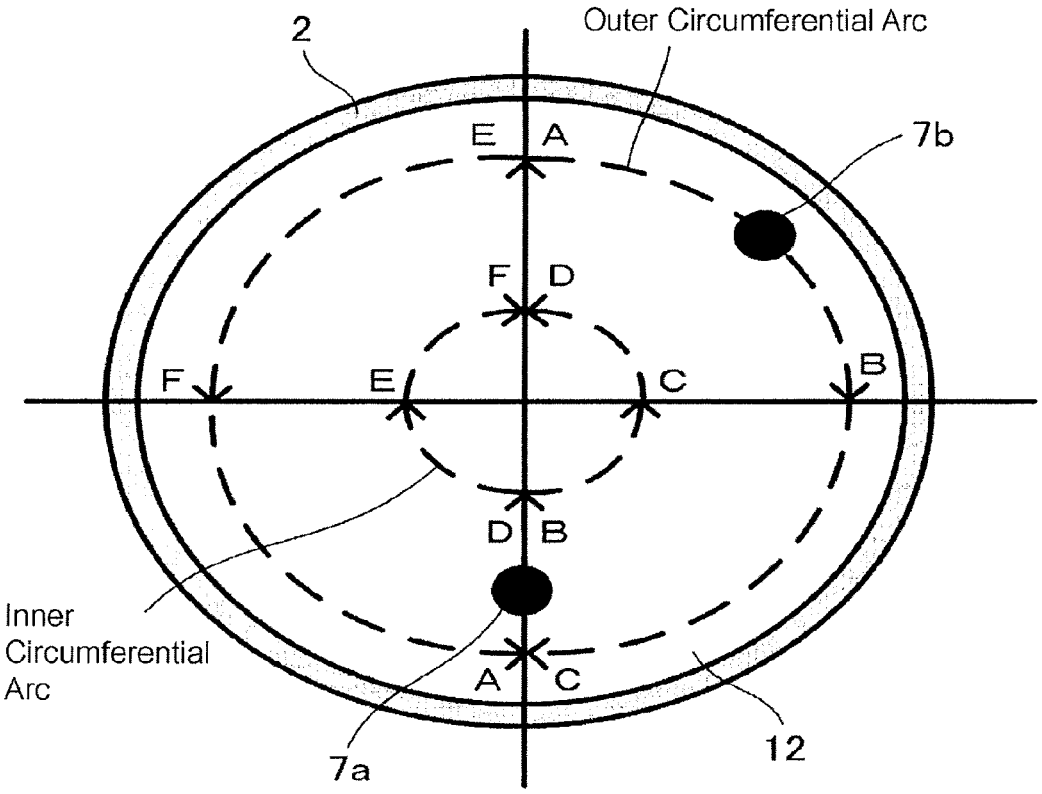
FIG. 24 A front view of the melt surface showing trajectories of movements of two plasma torches in a continuous casting apparatus according to another embodiment.

For example, as shown in FIG. 24, when the radius of the molten metal 12 (i.e., ingot 11) is assumed to be R, the plasma torches 7*a* and 7*b* may be controlled so that respective centers can trace the following trajectories during movement in the direction of A→B→C→D→E→F:

Inner circumferential arc having a radius of $0<r1<R/2$: B→C→D for the plasma torch 7*a*, and D→E→F for the plasma torch 7*b*

Outer circumferential arc having a radius of $R/2<r2<R$: E→F→A for the plasma torch 7*a*, and A→B→C for the plasma torch 7*b*

Straight line connecting two arcs, i.e., inner circumferential arc and outer circumferential arc: A→B and D→E for the plasma torch 7*a*, and C→D and F→A for the plasma torch 7*b*

That is, in FIG. 24, the plasma torches 7*a* and 7*b* are controlled so that respective centers can trace the following trajectories.

For plasma torch 7*a*:

A→B: straight line connecting two arcs, i.e., inner circumferential arc and outer circumferential arc B→C→D: inner circumferential arc (range of x>0)

D→F: straight line connecting two arcs, i.e., inner circumferential arc and outer circumferential arc E→F→A: outer circumferential arc (range of x<0)

For plasma torch 7*b:*

A→B→C: outer circumferential arc (range of x>0)

C→D: straight line connecting two arcs, i.e., inner circumferential arc and outer circumferential arc D→E→F: inner circumferential arc (range of x<0)

F→A: straight line connecting two arcs, i.e., inner circumferential arc and outer circumferential arc Also in such a case, the centers of two plasma torches 7*a* and 7*b* are moved to be located on trajectories formed after an inner circumferential arc having a radius of 0<r1<R/2 from the center of the melt surface and an outer circumferential arc having a radius of R/2<r2<R from the center of the melt surface are connected by a straight line, so that the entire melt surface can be heated without causing interference of two plasma torches 7*a* and 7*b* with each other.

Any other trajectories may be employed as long as the entire melt surface can be heated without causing interference of two plasma torches 7*a* and 7*b* with each other.

In the above-described continuous casting method of an ingot formed of titanium or a titanium alloy according to an embodiment of the present invention, two plasma torches 7*a* and 7*b* are used as the plasma torch, but the present invention is not limited thereto. Using a plurality of plasma torches, their trajectories may be ensured so that the entire melt surface can be heated without causing interference with each other.

DESCRIPTION OF REFERENCE NUMERALS AND SIGNS

1: Continuous casting apparatus
2: Mold
7*a*: Plasma torch
7*b*: Plasma torch
11: Ingot
12: Molten metal

The invention claimed is:

1. A method of continuously casting an ingot formed of titanium or a titanium alloy, comprising:

pouring a molten metal prepared by melting titanium or a titanium alloy into a top opening of a bottomless mold with a circular cross-sectional shape, whereby the molten metal may be solidified in the bottomless mold;

pulling the solidified molten metal in the mold downward to remove the solidified molten metal from the mold;

disposing a plurality of plasma torches on an upper side of molten metal in the mold such that centers of the plurality of plasma torches are located directly vertically above the molten metal in the mold;

operating the plurality of plasma torches to generate plasma arcs that heat the molten metal in the mold; and moving each of the plurality of plasma torches, while operated to generate the plasma arcs, in a horizontal direction above a melt surface of the molten metal in the mold, along a trajectory located directly vertically above the molten metal in the mold, while keeping a mutual distance between respective ones of the plurality of plasma torches such that the plurality of plasma torches do not interfere with each other, wherein for two of said plurality of plasma torches, assuming that a radius of the melt surface is R, the two plasma torches of said plurality of plasma torches are moved, during the step of moving each of the plurality of plasma torches, to locate their respective centers on a trajectory according to an inner circumferential arc having a radius r1 of 0<r1<R/2 from a center of the melt surface and an outer circumferential arc having a radius r2 of R/2<r2<R from the center of the melt surface, which inner and outer circumferential arcs are connected by a straight line, and a plasma output of each of said two plasma torches of said plurality of plasma torches during movement according to the inner circumferential arc is controlled to be lower than a plasma output during movement according to the outer circumferential arc.

2. The continuous casting method as claimed in claim 1, wherein the two plasma torches of said plurality of plasma torches are moved, during the step of moving each of the plurality of plasma torches, such that when one of the two plasma torches of said plurality of plasma torches is located directly vertically above the vicinity of an edge of the mold, the other of the two plasma torches of said plurality of plasma torches is located directly vertically above a central part of the mold.

3. The continuous casting method as claimed in claim 1, wherein each of the plurality of plasma torches is moved, during the step of moving each of the plurality of plasma torches, within a range of either one of two divided semicircles, as viewed from above the melt surface.

4. The continuous casting method as claimed in claim 3, wherein a distance of R/2 or more is maintained between the centers of the two plasma torches of said plurality of plasma torches during the step of moving each of the plurality of plasma torches.

5. The continuous casting method as claimed in claim 1, wherein a distance of R/2 or more is maintained between the centers of the two plasma torches of said plurality of plasma torches during the step of moving each of the plurality of plasma torches.

* * * * *